US011323798B1

(12) United States Patent
Mathur

(10) Patent No.: US 11,323,798 B1
(45) Date of Patent: May 3, 2022

(54) METAMATERIAL PASSIVE IMPEDANCE MATCHING DEVICE FOR A LOUDSPEAKER

(71) Applicant: Acoustic Metamaterials LLC, Scarsdale, NY (US)

(72) Inventor: Gopal P. Mathur, Trabuco Canyon, CA (US)

(73) Assignee: ACOUSTIC METAMATERIALS LLC, Scarsdale, NY (US)

( * ) Notice: Subject to any disclaimer, the term of this patent is extended or adjusted under 35 U.S.C. 154(b) by 0 days.

(21) Appl. No.: 17/539,304

(22) Filed: Dec. 1, 2021

Related U.S. Application Data

(60) Provisional application No. 63/213,785, filed on Jun. 23, 2021.

(51) Int. Cl.
*H04R 1/28* (2006.01)
*H04R 1/02* (2006.01)
*H04R 1/34* (2006.01)

(52) U.S. Cl.
CPC ..... *H04R 1/2803* (2013.01); *H04R 1/025* (2013.01); *H04R 1/2857* (2013.01); *H04R 1/345* (2013.01); *H04R 2201/029* (2013.01)

(58) Field of Classification Search
CPC ..... H04R 1/025; H04R 1/28; H04R 1/2803; H04R 1/2826; H04R 1/2853; H04R 1/2857; H04R 1/345; H04R 2201/029
See application file for complete search history.

(56) References Cited

U.S. PATENT DOCUMENTS 5,524,062 A * 6/1996 Oh ..... H04R 1/2842 381/338
5,689,573 A * 11/1997 Jones ..... H04R 1/22 381/345
9,959,855 B2 * 5/2018 Song ..... G10K 11/08
2018/0359558 A1 * 12/2018 Mathur ..... H04R 1/2857
2021/0097967 A1 4/2021 Logan et al.

OTHER PUBLICATIONS

Fok, Lee Ren, "Anisotropic and Negative Acoustic Index Metamaterials," PhD Dissertation in Engineering—Mechanical Engineering, University of California, Berkeley, 2010.

* cited by examiner

*Primary Examiner* — Huyen D Le
(74) *Attorney, Agent, or Firm* — Michael J. Feigin, Esq.; Feigin and Fridman LLC

(57) ABSTRACT

An acoustic metamaterial passive impedance matching device for use in matching the acoustic impedance of a loudspeaker is disclosed. The device includes a baffle having an upper end and a lower end, plates stacked concentrically from the upper end to the lower end, slots positioned between the plates, a side channel extending annularly around a circumference of at least one of the plates, and a spoke interconnecting the plates. Each of the plates includes a central region including perforations. Each of the slots is positioned between two adjacent plates. The side channel defines a chamber including a height greater than the height of the plates and an interior volume enclosing a predetermined volume of air. The side channels and the perforated plates generate an acoustic impedance that matches the complex conjugate acoustic impedance of the loudspeaker to deliver maximum acoustic power. The side channels may include open ends, closed ends, or both for providing an inductive or reactive capacitance.

13 Claims, 11 Drawing Sheets

$kr = (\omega/c)r = (2\pi f/c)r$; At 100 Hz; $k \approx 1.832$ $c = 343$m/s)
$r = 5.08$cm (2 inch), $kr \approx 0.093$

METAMATERIAL PASSIVE IMPEDANCE MATCHING DEVICE FOR A LOUDSPEAKER

FIELD OF THE DISCLOSED TECHNOLOGY

The disclosed technology relates generally to a passive impedance matching device for sound radiation from a sound source such as a loudspeaker. More specifically, the disclosed technology is related to enhancing acoustic performance of a loudspeaker by achieving impedance matching of sound radiation mainly on the front side of the loudspeaker using acoustic metamaterial (AMM) methods.

BACKGROUND OF THE DISCLOSED TECHNOLOGY

A loudspeaker is an electro-mechanical transducer, which radiates sound to both front and back side. While the front surface of the cone of a loudspeaker is pushing forward to create a sound wave by increasing air pressure, the back surface of the cone is lowering the air pressure.

The enclosure on the back side of a loudspeaker separates sound waves created from front side the speaker from the ones generated on the back. Because these waves are out of phase, they will cancel each other out when they meet or are allowed to merge, which would happen for a loudspeaker without a baffle or enclosure.

All loudspeakers require some form of isolation sound energy that will radiate off of the speaker backside. Baffles or some sort of enclosure is needed to maintain and define low frequency output. Enclosures are a way to implement infinite baffle on a loudspeaker. Loudspeaker enclosure can be thought of as a baffle wrapped around it on the back side. Thus, (loudspeaker) enclosure contains all the back radiation, which would have otherwise radiated away, as well its own modal characteristics imposed on it. The enclosure will obviously influence loudspeaker's front radiation.

Since loudspeaker diaphragm radiated on both sides, front and back, it creates acoustic pressure on its back inside the enclosure. Below the resonance frequency of the enclosure, acoustic pressure changes from positive to strongly negative which causes sudden drop in performance of the loudspeaker. Build up of negative pressure in the enclosure causes negative axial forces on the diaphragm, which do not allow it to create sound waves efficiently on the front side. This phenomenon is due to the pressure build-up around resonance peak in the back enclosure and exists all the way down to the lowest frequency. Thus, performance of the loudspeaker below the enclosure resonance frequency is controlled by pressure build-up in the enclosure.

Apart from the electro-mechanical impedance, loudspeaker, on the front side, is subjected to radiation impedance of the ambient medium, i.e., air.

Most speakers are actually very inefficient; only about 1% of the electrical energy sent by an amplifier to a typical home loudspeaker is converted to acoustic energy. The remainder is converted to heat, mostly in the voice coil and magnet assembly. The main reason for inefficient operation is the difficulty of achieving proper impedance matching between the acoustic impedance of the drive unit (i.e, loudspeaker diaphragm) and that of the air into which it is radiating. The efficiency of loudspeaker drivers varies with frequency as well. It is well known that if the acoustic impedance of the two media are very different, most sound energy will be reflected (or absorbed), rather than transferred across the border.

When the radiated wave from high impedance of the loudspeaker diaphragm reaches the transition of low impedance in the radiation (e.g., ambient medium) field, most of the power in the incident wave is reflected, rather than transmitted. For higher transmission to be achieved a matching intermediate impedance between the two regions is needed.

Consumer electronic devices, such as cell phones, tablets, and the like with more features and capabilities are ubiquitous and are positioning to become entertainment centers. However, they also exhibit severe audio deficiencies and provide many challenges to maintain the acoustic performance as enclosed acoustic volume size, power and diaphragm size are reduced significantly. Due to the smaller size of the speaker used in such devices, the low frequency response is severely affected. For example, as the size of the cell phone decreases, the volume of air behind the diaphragm is reduced. This small amount of volume behind the speaker limits the range of motion of the diaphragm. The speaker does not produce enough force to compress the air beyond a certain point, hence causing the air to push back. This reduces the displacement of the speaker diaphragm, which in turn lowers the output. Thus, low frequencies are affected the most by this phenomenon, as the diaphragm moves with the largest amount of displacement at these frequencies. Consequently, the frequency response usually rolls off faster at low frequencies (<1000 Hz). Thus, two key phenomena, namely high resonance frequency of diaphragm and small amount of back volume, severely impact performance of micro-speakers. Moreover, the back enclosure of a micro-speaker used in smartphone is usually sealed and is not accessible. This means that no modifications to the back enclosure can be made.

The total mass $M_{tot}$, and compliance $C_{tot}$, of the loudspeaker constitute a simple mass-spring system and create a resonance at the so-called fundamental resonant frequency $f_0$, determined b where, $C_{tot}$ is the total compliance of the inner and outer suspension system and the $M_{tot}$ includes mass $M_c$ of the voice coil and voice-coil cylinder and $M_d$ mass of the cone. This frequency is mostly chosen as low as possible since it determines the lower limit of the frequency response of the loudspeaker (in a sufficiently large baffle pressure and power responses decrease with 24 dB per octave with decreasing frequency below/p). The resonance frequency of micro-speakers used on consumer audio devices is around 1000 Hz. Below the diaphragm resonance frequency, the sound output of the micro-speaker falls at the rate of 12 dB per octave.

Previously, investigators have tried to modify the front radiation impedance of loudspeaker using active control. An active acoustic impedance system comprised of a loudspeaker in a closed cabinet connected to a feedback control loop based on a combination of pressure measured with a microphone and the velocity of the loudspeaker's membrane, acquired through an impedance bridge-motional feedback principle patented by Philips. Although this system covers a large bandwidth, it rapidly becomes instable as the gain of the counter reaction is increased. Furthermore, it is difficult to adjust the central frequency that the loudspeaker will absorb.

WIPO Publication No. WO 2014/053994 to Lissek et al (hereinafter "Lissek") provides an electric impedance synthesis method to be used in an electroacoustic device having broadband noise-reduction capacitors, which includes a step of defining the acoustic specifications based on a complex specified acoustic impedance, which varies with the frequencies, and responds to requirements in term of noise reduction. However, such methods are applied to using loudspeaker as a noise reduction device rather than its original function as an electro-acoustic transducer. One limitation of this system is that it is intrinsically unsteady depending on the type of electric impedance that is connected to the loudspeaker.

WIPO Publication No. WO 2016/083971 to Roux et al (hereinafter "Roux") provides an adaptive device that adjusts to absorb the predominant resonant frequencies of a closed area or a large room. It also provides a large active absorption area, significantly larger than the area of the transducers used. This device aims to transform an electroacoustic transducer into a versatile electroacoustic resonator for absorbing sound energy in a space or to contain this energy between two adjacent spaces without using sensors to reach the desired noise reduction.

Published article "Advanced control for modifying the acoustic impedance at the diaphragm of a loudspeaker," Acoustics 2012, April 2012, Nantes, France. hal-00810907, authored by R. Boulandet et al. (hereinafter "Boulandet") addresses active control of a loudspeaker via an active electrical source connected at the terminals. By sending back a control voltage proportional to the sensed acoustic variables, the diaphragm acoustic impedance can be matched to the characteristic impedance of air, i.e. $Z_c=\rho c$. It results in an optimal sound absorption, specifically in the low-frequency range where the usual passive soundproofing means are ineffective, or their embodiment would become almost impractical. The diaphragm of electroacoustic transducers is used as refracting surface that controls the reaction of some boundaries of the sound field. The general idea is to absorb the incident sound energy or to contain it, simply by altering the transducer dynamics in a controlled fashion. A direct-radiating electro-dynamic loudspeaker can thus be transformed into an active electroacoustic resonator. Through the use of sensors and controller, it is proposed how to achieve broadband sound absorption at the transducer diaphragm. They used loudspeaker diaphragm impedance as control error for the active control strategy.

Radiation resistance represents the energy lost by the piston and/or loudspeaker. Indeed, the radiation resistance determines the amount of power, which propagates into the medium. On the other hand, the imaginary part, the radiation reactance, represents the amount of energy stored in the medium in the vicinity of the piston to facilitate this propagation.

Metamaterials are broadly defined as artificial composite materials specifically engineered to produce desired unusual properties not readily available in nature.

Accordingly, there is a need for a passive impedance matching device for enhancing acoustic performance of a loudspeaker by achieving impedance matching of sound radiation mainly on the front side of the loudspeaker using acoustic metamaterial (AMM) methods.

SUMMARY OF DISCLOSED TECHNOLOGY

The present disclosed technology provides an acoustic metamaterial (AMM) passive impedance matching device and system, designed to provide optimum impedance on the front side of a loudspeaker to significantly improve its broadband acoustic performance and overcome and/or match the adverse complex impedance load presented by the radiation impedance of a loudspeaker. The AMM device includes a combination of resistive and inductive acoustic elements to match the resistive and reactive features of the radiation impedance load of a loudspeaker. A combination of resistive and a reactive impedance including inductive and capacitive elements in the transmission line model may also be used for enhancing loudspeaker performance over a given broad band frequency range. Passive management of acoustics of loudspeaker radiation can thus be achieved with various compatible configurations of the AMM impedance device.

In some embodiments, the acoustic metamaterial passive impedance matching device includes a baffle including an upper end and a lower end adapted to attach to the loudspeaker, the upper end opposite the lower end, a plurality of plates stacked concentrically with respect to one another from the upper end to the lower end, each of the plates including a central region including a plurality of perforations, a plurality of slots positioned between the plates, a slot of the plurality of slots positioned between two adjacently stacked plates, a side channel extending annularly around a circumference of at least one of the plurality of plates, the side channel defining a chamber including a height that is greater than the height of the plates and an interior volume enclosing a predetermined volume of air, and a spoke interconnecting the plurality of plates to one another, the side channel and the perforations generating an acoustic resistance that matches the acoustic resistance of the loudspeaker.

In embodiments, the side channel includes a plurality of side channels spaced periodically between the plates.

In certain embodiments, the plurality of side channels and the plurality of plates alternate in arrangement.

In other embodiments, the plurality of side channels each include open ends to provide an inductive reactance.

In some embodiments, each of the plurality of plates includes a different quantity of perforations with respect to each of the other of the plurality of plates.

In embodiments, the quantity of perforations per plate decreases from the upper end toward the lower end, such that the topmost plate includes more perforations while the lowermost plate includes the least perforations.

In certain embodiments, the quantity of side channels and the quantity of perforations on each individual plate are functions of the resistance of the loudspeaker, the quantity of the side channels and the pattern and the quantity of the perforations are dependent on the resistance reactive impedance of the loudspeaker.

In other embodiments, the dimension of the side channels is a function of the reactance of the loudspeaker, the dimensions of the perforated plates dependent on the resistance of the loudspeaker.

In some embodiments, the plates increase in diameter from the upper end to the lower end, such that the plate furthest from the loudspeaker includes the smallest diameter and the plate closest to the loudspeaker includes the largest diameter.

In embodiments, the plates are uniform in diameter from the upper end to the lower, such that the plates include substantially equal diameters.

In some embodiments, the plurality of side channels further comprises a second set of side channels, each side channel including closed ends to provide a capacitive reactance.

In certain embodiments, the lower end of the baffle includes a bracket for mounting the baffle to the loudspeaker.

In other embodiments, the bracket includes a plurality of mounting apertures protruding outwardly from baffle, each of the mounting apertures corresponding to mounting holes of the loudspeaker, the mounting apertures configured to receive a fastener there-through for securing the mounting apertures to the mounting holes.

"Metamaterial" refers to "any material engineered to have a property that is not found in naturally occurring materials, which may be made from assemblies of multiple elements fashioned from composite materials such as metals and plastics". "Impedance" refers to "the effective resistance of an electric circuit or component to alternating current, arising from the combined effects of ohmic resistance and reactance." "Inductance" refers to "the property of an electric conductor or circuit that causes an electromotive force to be generated by a change in the current flowing." "Resistance" refers to "the degree to which a substance or device opposes the passage of an electric current, causing energy dissipation." "Capacitance" refers to "the ratio of the change in an electric charge in a system to the corresponding change in its electric potential." "Radiation" refers to "the emission of energy as electromagnetic waves or as moving subatomic particles, especially high-energy particles which cause ionization." "Resonance" refers to "increased amplitude that occurs when the frequency of a periodically applied force is equal or close to a natural frequency of the system on which it acts." "Resonance frequency," also know as "resonant frequency," refer to "the natural frequency where a medium vibrates at the highest amplitude." "Resonator" consists of "an electronic device consisting of a combination of elements having mass and compliance whose acoustical reactances cancel at a given frequency." "Acoustic transducer" refers to "a device that converts acoustic energy to electrical or mechanical energy." "Bulk modulus" refers to "the ratio of the infinitesimal pressure increase to the resulting relative decrease of the volume of a substance." "Anisotropic" refers to "having a physical property that has a different value when measured in different directions, or varying in magnitude according to the direction of measurement." "Resistor" refers to "a device having a designed resistance to the passage of an electric current."

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

Figure 1:
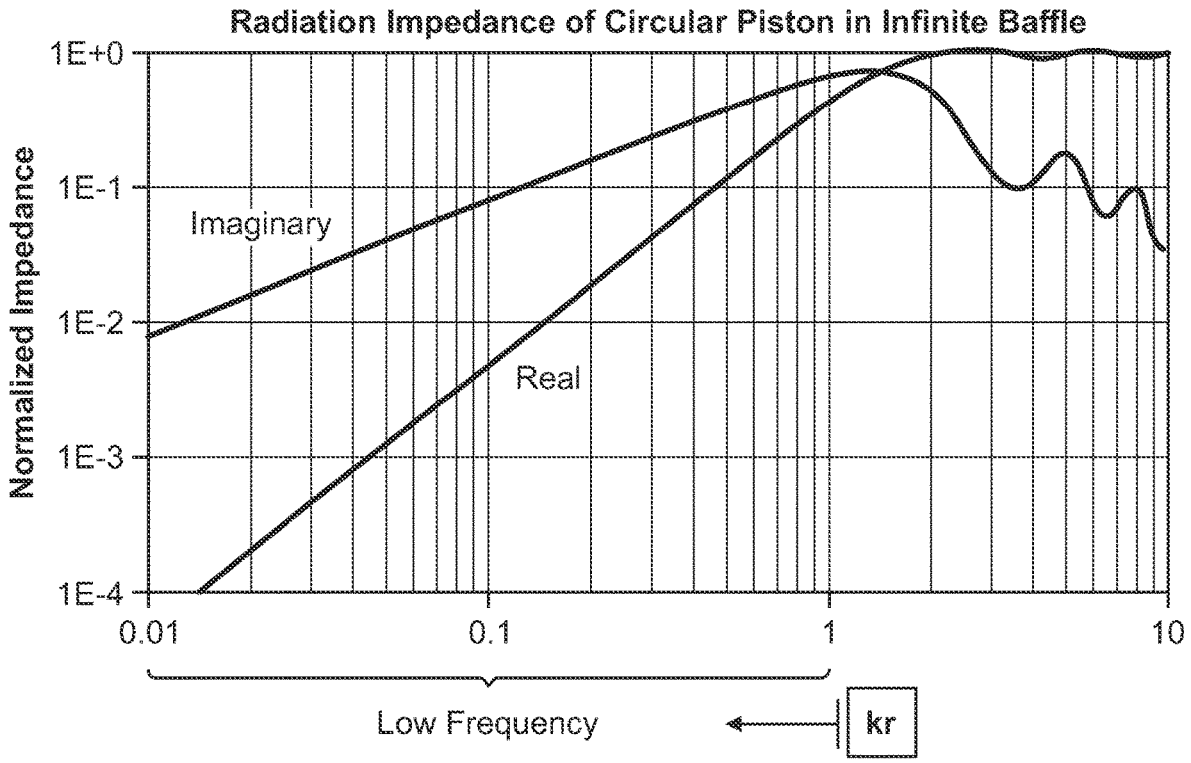
FIG. 1 shows a two-dimensional graph illustrating normalized acoustic radiation impedance of a circular piston in an infinite baffle according to one embodiment of the present disclosed technology.

The present disclosed technology provides an acoustic metamaterial passive impedance matching device for use in matching the complex radiation impedance load of a loudspeaker. The device includes a baffle having an upper end and a lower end, a plurality of plates stacked concentrically from the upper end to the lower end, a plurality of slots positioned between the plates, a side channel extending annularly around a circumference of at least one of the plates, and a spoke interconnecting the plates to one another. Each of the plates includes a central region including a plurality of perforations. Each of the slots is positioned between two adjacently stacked plates, such that one slot is positioned between two adjacent plates. The side channel defines a chamber including a height that is greater than the height of the plates and an interior volume enclosing a predetermined volume of air. The side channel and the perforations generate an acoustic resistance that matches the acoustic resistance of the loudspeaker. The side channels include open ends, closed ends, or both for providing an inductive or reactive capacitance.

The main objective of this disclosure is to devise a method for management of acoustics and impedance matching of the loudspeaker to maximize sound power radiation from and enhance loudspeaker performance using acoustic metamaterial (AMM) principles.

Impedance originally was used to indicate a capacity of medium that impedes or restricts current flow; however, a more accurate description would be that impedance impedes the flow of energy. The radiation impedance of a vibrating object is typically defined in the same manner as a mechanical impedance, that is, as the ratio of force to velocity.

Most speakers are very inefficient; only about 1% of the electrical energy sent by an amplifier to a typical home loudspeaker is converted to acoustic energy. The remainder is converted to heat, mostly in the voice coil and magnet assembly. The main reason for this is the difficulty of achieving proper impedance matching between the acoustic impedance of the drive unit and that of the air into which it is radiating. The efficiency of loudspeaker drivers varies with frequency as well.

The load, i.e., the radiation impedance $Z_R$, that the surrounding air places on the radiator (i.e., loudspeaker), is an important factor. The knowledge of $Z_R$ allows us to quantify: (1). Power radiated from a source to the environment, and (2). The resistive and reactive forces of the medium on the source.

The imaginary part of the radiation impedance (the radiation reactance) can be thought of as governing the energy stored in the fluid that continually reacts with the vibrating surface and affects or impedes its motion. This stored energy does not travel away from the radiator. If the application of interest requires the efficient generation of sound, such as for a listener from a loudspeaker, then a high radiation resistance and a low radiation reactance is desired.

Compared to the plane wave situation, a spherical wave is much closer to waves encountered in the real world. A typical loudspeaker can be considered a spherical-wave source. Spherical sound waves expand in three dimensions—like an expanding sphere: out, left and right, and up and down.

The pressure and particle velocity for spherical waves are exactly out of phase for $r/\lambda=0$, while for $r/\lambda\rightarrow\infty$ they are in phase, and the specific impedance seen by the wave is again the same as seen by the plane wave case ($r\rightarrow\infty$):

$$Z_a=\rho_0 c.$$

When loudspeaker operates in an evacuated chamber dominant contributions to the impedance come from the membrane mass or piston M and intrinsic membrane friction $R_i$ indicated by the viscoelastic properties of the membrane material.

A circular piston in a large baffle is a good approximation for investigating the radiation of sound from a boxed loudspeaker, The real and imaginary parts of radiation impedance of a circular piston are given by:

$$Z_R = \rho_0 cS\left[1 - \frac{2J_1(2ka)}{2ka}\right] + j2\rho_0 cS\left[1 - \frac{2H_1(2ka)}{2ka}\right],$$

where, speed of sound is denoted by c, while a and S are respective piston radius and area, and $k=\omega\pi c$ is the wave number. $J_1$ (2 ka) is the upper order Bessel function, and in practical computations approximation of Struve function $H_1$(2 ka), put forward by Aarts and Janssen. This impedance determines the speaker's effectiveness as a source of sound.

The resistive component is the only part involved in radiation of real sound energy. Thus, the radiated sound energy related to the real part of the radiation resistance is useful and represents the power output of the loudspeaker.

The sound power used up by radiation reactance, on the other hand, "is 'watt-less' power, involving energy which surges out from the source and then back towards the source, without ever being radiated as sound waves" and that it involves "the mass or inertial property of the air that is involved." It is "the mass reaction of the medium to the vibrating sphere", the "additional apparent mass of the sphere", and "accession to inertia." It is "a term proportional to the surface particle acceleration, embodying the inertia force associated with the accession to inertia or entrained mass of fluid set into motion by the pulsating surface of the spherical source. "The fluid surrounding the source behaves like an effective mass". It should be noted that accession refers to the new attainment or something, in this case inertia. The fluid mass is additional mass that the vibrating surface must now move. To entrain means to draw along with, meaning that the mass moves along with the vibrating surface.

As described by the maximum power transfer theorem, a power source with source impedance $Z_s$ will transfer the maximum amount of power to a load impedance $Z_s$* (e.g., ambient load) which is the complex conjugate of the source impedance. The theorem includes reactance, and states that maximum power transfer occurs when the load impedance is equal to the complex conjugate of the source impedance.

The mechanical radiation impedance is given by $$Z_{m,r}=\rho c\pi a^2(R_1+jX_1).$$

Its low frequency approximation is therefore:

$$Z_{m,r} = \frac{\pi a^4 \rho c k^2}{2} + j\omega\rho\frac{8a^3}{3}.$$

The imaginary part of this impedance is the impedance of the mass of a layer of air in front of the piston. This layer of air is moving back and forth as if it were incompressible.

Complex acoustic power generated by a loudspeaker array consists of a real part, i.e., active acoustic power, and an imaginary part, i.e., reactive acoustic power. The active and reactive acoustic powers are associated with the net transport of energy and local oscillatory transport of energy, respectively. The active acoustic power propagates to the far field, whereas the reactive acoustic power does not.

The effectively radiated power W by moving piston is:

$$W=Q^2\times\mathrm{Re}[Z_R]$$

where, Q: volume flow (product of velocity and piston area) and $\mathrm{Re}[Z_R]$: real (active) part of radiation impedance. The normalized complex impedance of a circular piston in an infinite baffle is shown in FIG. 1. The x-axis (kr) is normalized with respect to the radius of the piston and can be interpreted accordingly ($k=\omega/c$ and r is radius of loudspeaker).

Figure 2:
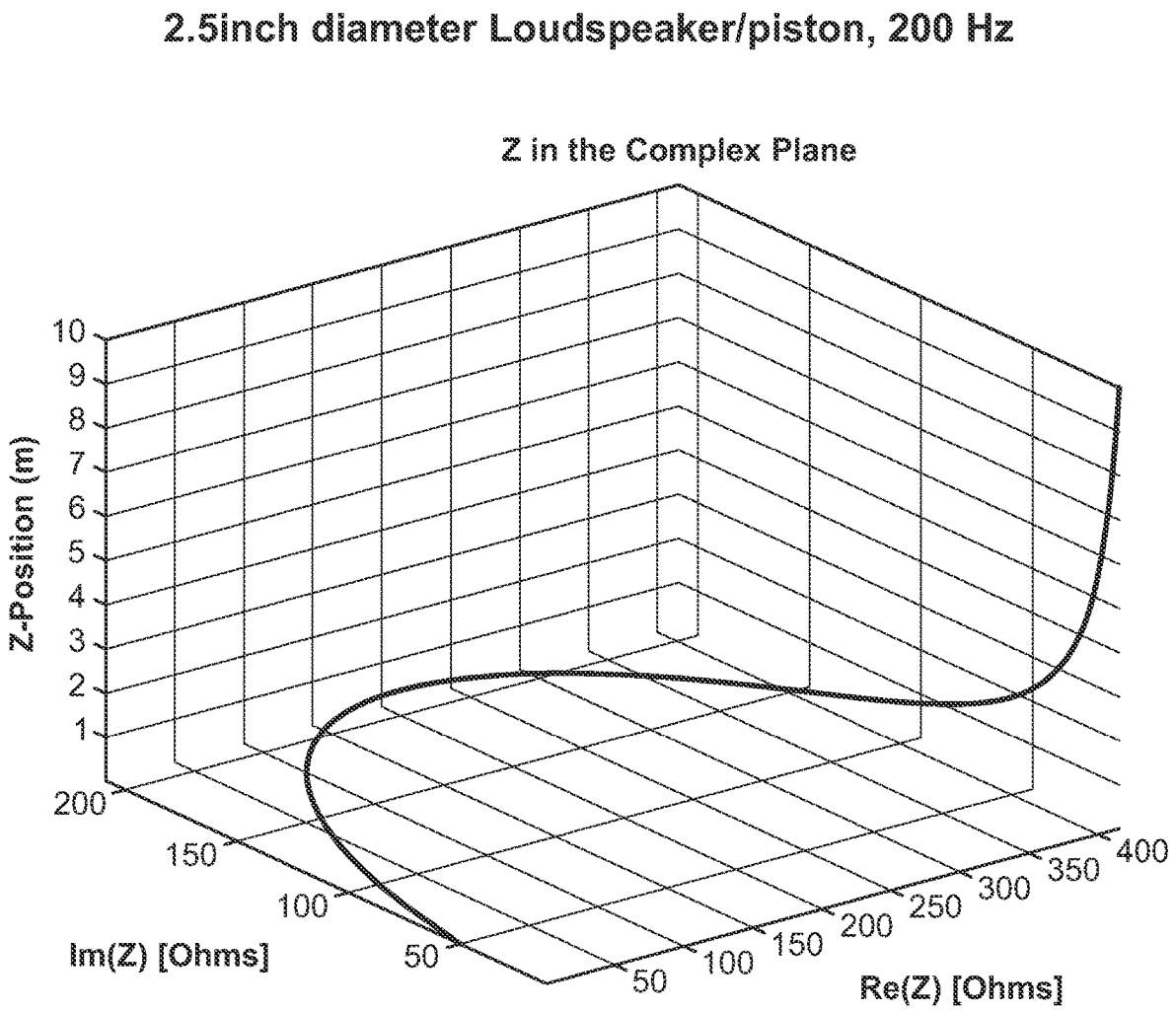
FIG. 2 shows a three-dimensional graph illustrating acoustic radiation impedance ($Z_R$) of a circular piston in an infinite baffle, including real and imaginary parts in complex plane, according to one embodiment of the present disclosed technology.

The real and imaginary parts of the impedance of a piston of radius (a=5.08 cm) at a frequency of 200 Hz are shown in the complex plane (3-dimensional) in FIG. 2.

Figure 3:
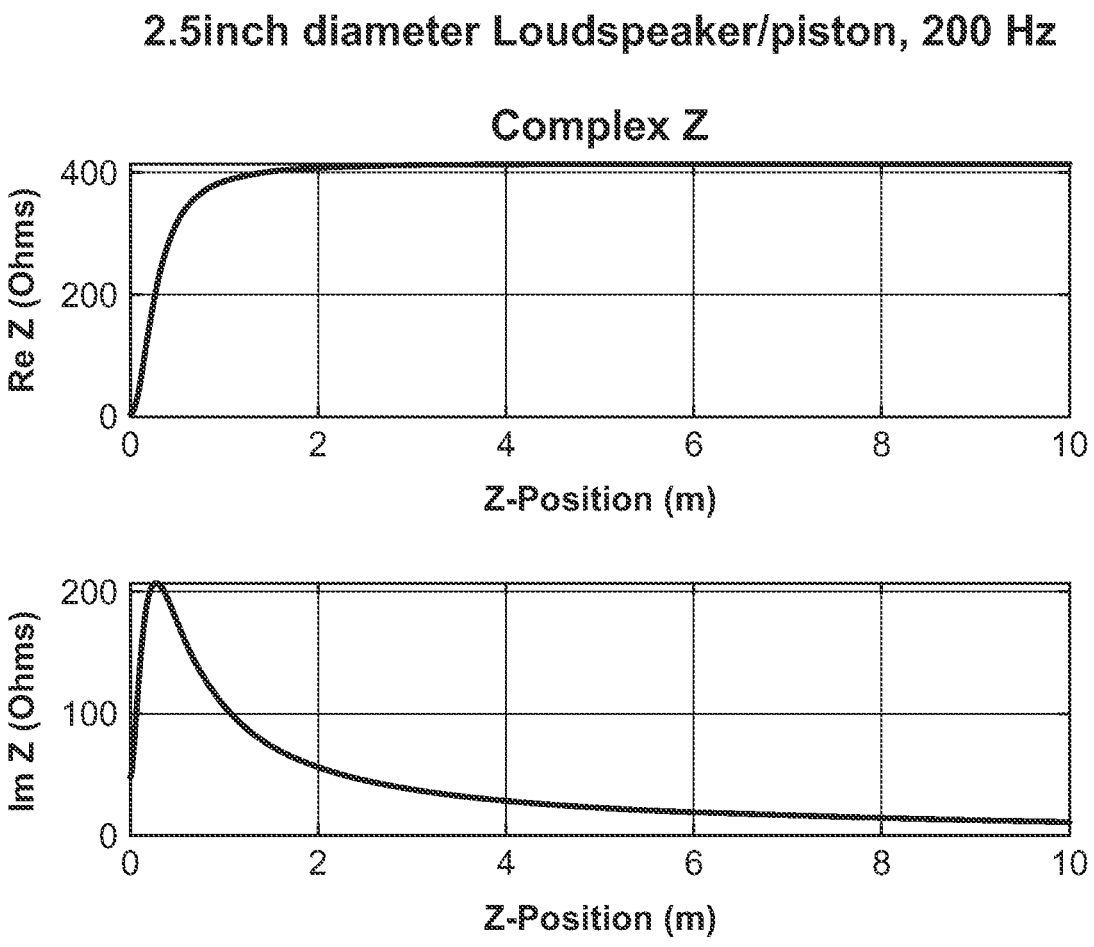
FIG. 3 shows a pair of two-dimensional graphs illustrating acoustic radiation impedance ($Z_R$) of a circular piston in an infinite baffle, including real and imaginary parts with normal distance (z) from the piston, according to one embodiment of the present disclosed technology.

FIG. 3 shows real and imaginary parts of impedance (Z) with respect to normal distance from the loudspeaker. The imaginary part, which is the reactive part of the radiation impedance, is more dominant near the radiating surface, whereas the resistive part is lower than the reactive part, as observed in FIG. 3.

The complex radiation impedance for a loudspeaker of radius 1.25 inch is shown in FIG. 2 and FIG. 3. It may be observed that the imaginary part in the very near-field (i.e., $z \rightarrow 0$) is of lower magnitude and builds up to a higher value and then goes down to lower values, whereas the real part of the impedance slowly increases with distance, as shown in FIG. 2.

At low frequencies (when ka is small, ka<1) a loudspeaker radiates sound equally well in all directions. A boxed loudspeaker will even radiate low frequency sound into the region behind the box. The far-field pressure radiated by a baffled piston depends on the radius of the piston a, the frequency (through the wavenumber k and the direction θ (with θ=0° being directly in front of the piston).

For small values of 2 ka, $X_1$ (2 ka<<1)=8(ka)/3π. The reactive part of the radiation impedance, $\rho_m c\pi a^2 X_1$, represents the baffled piston's (near-field) hydrodynamic mass loading. The force corresponding to this mass reactance can be written in terms of the fluid density times a cylindrical volume of fluid that has the same area as of the piston, $\pi a^2$, and a height h=8a/3 π. As ω=ck, or by the following:

$$\lim_{lim2ka\rightarrow 0}(F_{Reactive})=j\mathrm{Im}[Z_{mech}v_1]=j\rho_m c\pi a^2(8ka/3\pi)=j\omega(\rho_m \pi a^2(8a/3\pi))=j\omega m_{eff}$$

Thus, an effective mass of air, $m_{eff}$, is placed in front of a piston or loudspeaker, which acts as the reactive impedance. This reactive impedance needs to be counteracted before all the energy from near-field of the piston can propagate to far-field without any impediment.

The reactive impedance, $j\omega m_{eff}$, in the near-field of the loudspeaker is like that of an inductive element. In the low-frequency limit, an open tube is called an acoustic inductance or an inertance and it has a direct analogy to the inductance in electrical circuit analysis or the mass in mechanical system analysis. The acoustic impedance of an open tube of length, L, and area A, is then given by:

$$Z(\omega)=\{P(\omega)\}/\{U(\omega)\}=j\omega(\rho_m L/A),$$

where, U (ω)=AV (ω) is the acoustic volume velocity of the air mass and P(ω) is applied sinusoidal pressure.

For the same speaker diameter, the value of ka increases (ka>1) as the frequency gets higher, and the speaker becomes directional. That is, the sound energy produced by the speaker becomes channeled into a preferred direction and very little energy is radiated at other directions.

Using acoustic metamaterials, acoustic wave propagation can be controlled by appropriate design of the refractive index distribution of the medium. In addition to the refractive index, the acoustic impedance also affects the sound propagation characteristics. For loudspeaker, the radiation impedance allows the phase relationship between the surface pressure and the object velocity to be quantified. At low frequencies, these two quantities are generally not in phase, with the velocity lagging behind the surface pressure by 90°.

It is possible to obtain some extraordinary acoustic fluid parameters (ρ and B), i.e., density and bulk modulus, by modifying the structural parameters of acoustic metamaterials, that cannot be realized easily using natural materials. These parameters include negative mass density and negative bulk modulus values, anisotropic mass density tensors, and anisotropic elasticity tensors.

Recently, metamaterials with simultaneously negative permittivity (ε) and permeability (μ), more commonly referred to as left-handed (LH) materials, have received substantial attention. In the realm of electromagnetics, there is a common distinction between two types of metamaterials: arrays of resonant inclusions, such as the split-ring resonator and transmission line (TL) based metamaterials. While the materials of the upper kind are inherently narrow band and lossy due to their resonant nature, the latter can exhibit the desired meta-properties, such as negative refraction, over a much larger bandwidth and with lower losses since they do not explicitly rely on resonance.

Most of the acoustic metamaterials reported to date belong to the category of resonant inclusions, whereas very few works on the acoustic counterparts of TL-based metamaterials have been reported. This requires the realization of acoustic or mechanical elements, which implement shunt "inductances" (i.e., acoustic masses) and series "capacitances" (i.e., acoustic compliances).

Left-handed materials (LHMs), which in a wider sense, are also referred to as negative index materials (NIMs), simultaneously have negative permittivity, ε, negative permeability, μ, and negative refractive index, n, over a common frequency band. The term "left-handed material" (LHM) was first introduced by Veselago in 1968, who predicted there exists such a medium in which the electric field, E, the magnetic field, H, and the wave vector, k, form a left-handed orthogonal set. However, left-handed materials do not exist in nature.

Transmission line approach is based on the dual of a conventional transmission line. Backward wave transmission line (TL) can form a non-resonant LHM. Series capacitance ($C_L$) and shunt inductance ($L_L$) combination supports a fundamental backward wave. Perfect LH TL is not resonant dependent but has a low loss and broad-band performance.

An acoustic metamaterial that does not cause reflections at boundaries in all frequency regions while exhibiting positive and negative refractive index properties will be preferential. In most of the cases, an anti-reflection property was only achieved at a specific refractive index range or angle of incidence, and there have been no reports to date of an anti-reflection property being achieved for all refractive indices, including positive and negative indices, and regardless of the angle of incidence. In transmission line metamaterials, the impedance of the metamaterial can be matched with that of the air when the balanced condition is satisfied. This condition can be achieved by ensuring that the product of the shunt inductance and the capacitance has the same value as the product of the series inductance and the capacitance (e.g., $L'_{RH}C'_{LH}=L'_{LH}C'_{RH}$). The lumped series capacitance is indexed, $C_{LH}$, and the shunt inductance, $L_{LH}$, LH stands for left-handed. In such a balanced metamaterial, reflections can be strongly suppressed and the transmission can be maximized over the entire refractive index range.

The balanced (CRLH) meta material approach can now be seen as an implementation of the maximum power transfer theorem. It also explains how the maximum power transfer really works and can be achieved in nature.

Circuit-theory concepts have been used to conceptualize and design an acoustic non-resonant TL-based metamaterial. Series compliances were implemented using membranes whereas the shunt acoustic masses have been realized with transversally connected open channels. Such a metamaterial exhibits a negative refractive index over almost one octave (0.6-1 kHz), which is larger than what can be achieved with locally resonant acoustic metamaterials. However, one-octave coverage is very inadequate for audio applications and must be extended over at least 3 or more octaves.

In the present disclosed technology, an acoustic metamaterial impedance matching device for a loudspeaker, using perforated plates and open-tube composite architecture, that is impedance matched for a loudspeaker with air for all refractive indices including negative indices, is disclosed. This arrangement is highly distinctive and different from previous attempts and is based on the fact that the loudspeaker radiation impedance itself, as described earlier, consists mostly of resistive and inductive elements. It is important to note that the resistive and inductive impedance of a loudspeaker needs to be matched with a similar but conjugate environment. When needed, a compliance type acoustic structure may also be added to the metamaterial unit for achieving a well-matched impedance device. It may be noted that the unit cell consisting of an open channel and a perforated plate has a parasitic compliance, which will be added to the CRLH TL circuit.

The constituent parameters that determine the propagation characteristics of acoustic waves in a medium are the density of the medium ρ and its bulk modulus B. The velocity of an acoustic wave in the medium $v_p$ and the refractive index relative to air n are given by:

$$v_p = \sqrt{\frac{B}{\rho}}, n = \sqrt{\frac{\rho_r}{B_r}},$$

where, $B_r=B/B_0$ and $\rho_r=\rho/\rho_0$ are the relative values of the bulk modulus and the mass density of the medium, respectively, with respect to values in air, which are $B_0=1.42\times10^5$ Pa and $\rho=1.22$ kg/m$^3$.

The inductor and capacitor are analogous to open end and closed end pipes, respectively. By alternatively positioning acoustic inductors and capacitors, the negative refractive index can be achieved. The acoustic mass is equivalent to the mass of the air in the enclosed element divided by the square of the cross-sectional area of the element. Also, since some small volume of the medium on either end of the tube is also entrained with the media inside the tube, the "acoustic" length is usually somewhat larger than the physical length of the tube. For a single open end, the difference between the physical length and the acoustic length is $\Delta l\approx0.8a$, also called the end correction. A structure that may be well approximated by an acoustic compliance is an enclosed volume of air with linear dimensions ($<0.1\lambda$). The variations in sound pressure within an enclosed air volume generally occur about the steady-state atmospheric pressure, the ground potential in acoustics.

Figure 4A:
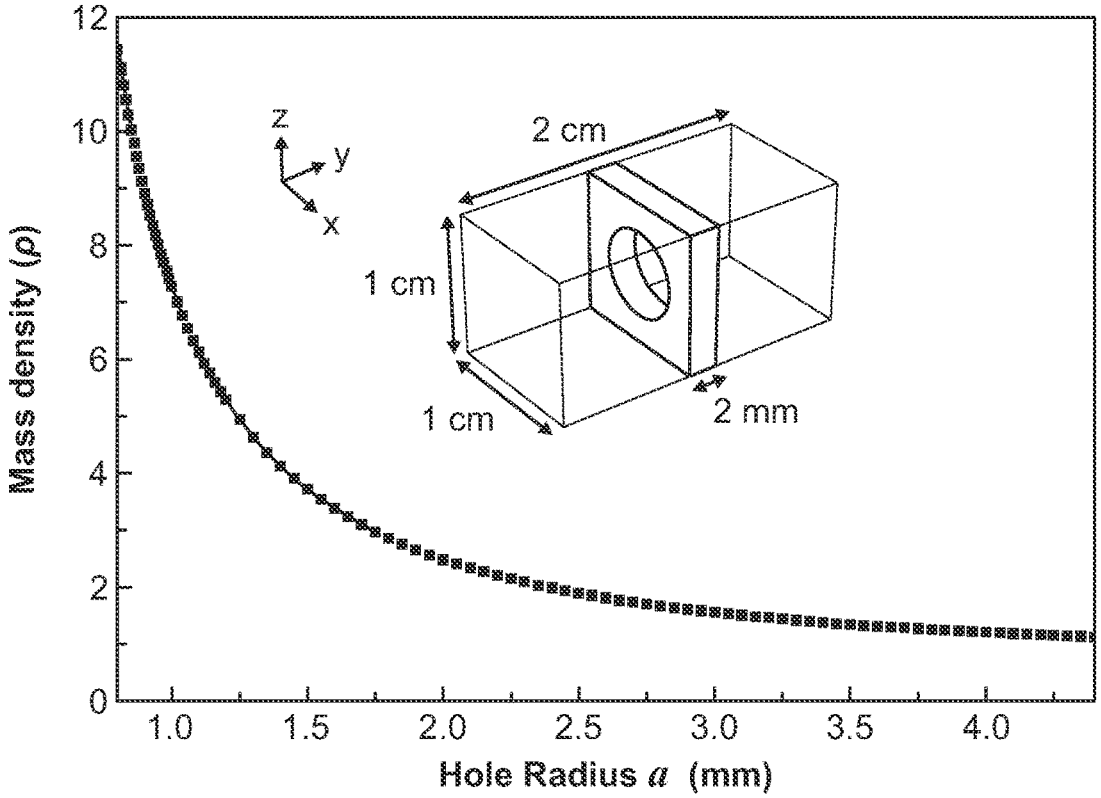
FIG. 4A shows a two-dimensional graph illustrating (a) the mass density with respect to the geometrical parameters for the unit cell with the perforated plate and (b) the bulk modulus with respect to the geometrical parameters for the unit cell with the perforated plate shown in graph (a), according to one embodiment of the present disclosed technology.
Figure 4B:
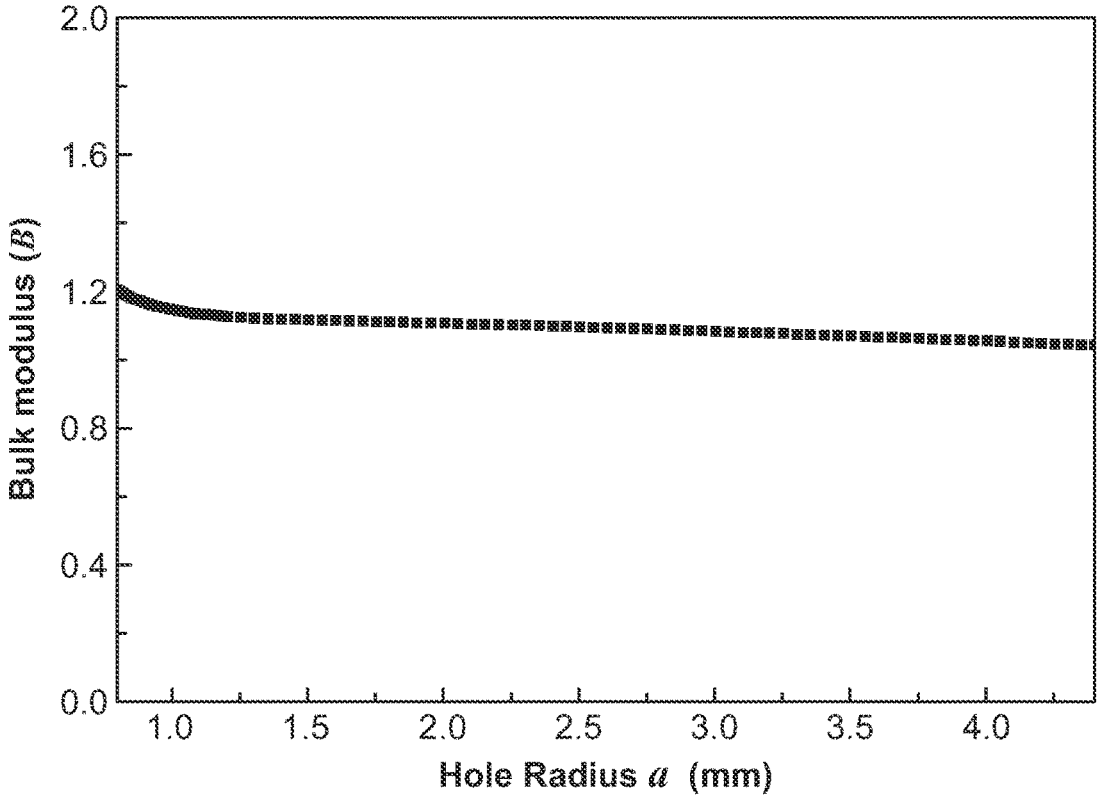
FIG. 4B shows a two-dimensional graph illustrating the bulk modular with respect to hole radius.

The action of an acoustic resistor is to absorb sound power. The viscous forces within a narrow tube convert the sound power into heat that dissipates away. A narrow tube or radius a ($<<0.001\lambda$) can represent an acoustic resistor. Thus, a perforated plate with miniature holes can provide desired resistance. The perforated plate can be regarded as a tiny pipe with an impedance of $Z'_0=\rho_0c_0/S$. Thus, the variation of the sectional area of the hole is equivalent to the variation of the effective mass density, where a larger radius leads to a smaller effective mass density. A unit cell with a perforated plate, shown in FIG. 4A, graph (a) can be used to modulate the mass density of the medium by varying the radius of the hole. FIG. 4B shows a two-dimensional graph illustrating the bulk modular with respect to hole radius. The size and shape of the perforation determines the momentum in the rigid plate produced by a wave propagating perpendicular on the plate, and, therefore, can be used to control the corresponding mass density component seen by this wave. This property is used to obtain the higher density component. If, on the other hand, the wave propagates parallel to the plate, it will have a very small influence on it, and consequently the wave will see a density close to that of the background fluid. The compressibility of the cell, quantified by the lower effective parameter, the bulk modulus, is controlled by the fractional volume occupied by the plastic plate.

The mass density of a perforated plate in one direction will be controlled by the hole dimension (radius) and in the other direction by the plate thickness. The effective bulk modulus will be controlled by the solid portion over the air volume ratio. The effective material parameters in the transverse orientation are dictated only by the slab thickness and are minimally influenced by the hole radius. The resistance (i.e., impedance) offered by a perforated plate can be calculated using formulae given in "Acoustic impedance of small, circular orifices in thin plates," J. Acoust. Soc. Am., vol. 77, issue 6, pp. 2039-2042, 1985 authored by M. R. Stinson and E. A. G. Shaw and COMSOL MultiPhysics, 5.5 Acoustics Module Users Guide, p 246, 2020.

When open tubes (OTs) are installed periodically as lumped elements in a one-dimensional acoustic waveguide, the pressure amplitude in the waveguide is affected by the dynamic motion of the air column that exists in the OT, and the value of the bulk modulus thus changes. In this case, the bulk modulus of the medium B is given by:

$$B=B_0/[1-(\omega^2_{OT}/\omega^2)],$$

where the transition frequency of the bulk modulus is given by $$\omega_{OT} = c\sqrt{\frac{s}{l'dA}}$$

and, if only OTs have been installed, the mass density of the metamaterial ρ is equal to that of air $\rho_0$. Here, c, S, l', d, and A are the speed of sound in air, the cross-sectional area of the OT, the effective length of the OT, the unit cell length, and the cross-sectional area of the waveguide, respectively.

Figure 5:
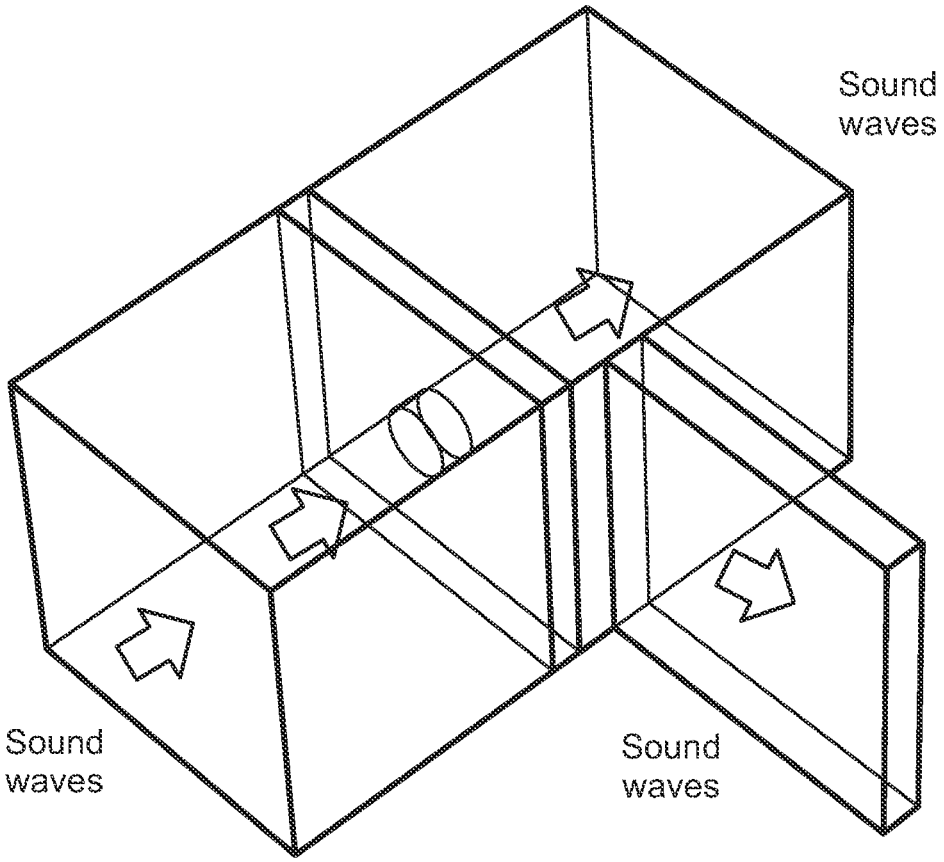
FIG. 5 shows a perspective view of the unit cell with the perforated plate and an open side channel, shown as a rectangular tube, according to one embodiment of the present disclosed technology.

The two types of unit cells, e.g., perforated plates and open channels (e.g., tubes), can be combined to obtain a new complex unit cell, as shown in FIG. 5, which can be used to modify the mass density and bulk modulus, needed to modify resistance and reactance, in the near-field of loudspeaker simultaneously.

A side tube in a unit cell could be used to modulate the bulk modulus of the medium by varying the side tube's height. The change in pressure in the main tube is $p=-B_0(\Delta V-\Delta V_h)/V$, and the change in pressure in the side tube is $p_h=-B_0DV_h=\Delta V_h/V_h$. Here, V and $V_h$ represent the volumes of the main tube and the side tube, respectively, while ΔV and $\Delta V_h$ are the small changes in the main tube and side tube volumes, respectively. The effective bulk modulus is only dependent on the observable volume change ΔV, and thus, the formula becomes $p=-B_{eff}\Delta V/V$. Because $p=p_h$, the effective bulk modulus is given by $B_{eff}=B_0/(1+V_h/V)$, which means that as the height of the side tube increases, the effective bulk modulus decreases.

In the case of an acoustic metamaterial with a composite structure in which perforated plates and open channels are arranged alternately, each lumped element affects the constituent parameters of the medium independently. The static density of the medium then becomes ρ' rather than $\rho_0$ because of the effect of the perforated plate, and the transition frequency of the bulk modulus should be modified to take the form $\omega_{OT}=c\sqrt{(\rho S/\rho_0 l' dA)}$, which comes from the continuity equation of the medium.

Knowing the near-field radiation impedance of the loudspeaker $Z_R$, the effective parameters of the required unit cells can be calculated using the well-developed retrieval method disclosed in "Method for retrieving effective properties of locally resonant acoustic metamaterials." Phys. Rev. B, 76(14):144302, 2007, authored by V. Fokin, M. Ambati, C. Sun, and X. Zhang, or they can be evaluated using finite element methods. The effective refractive index n and impedance Z are obtained from the reflection and transmission coefficients of a plane wave that is normally incident on the metamaterial. The effective mass density $\rho_{eff}$ and bulk modulus $B_{eff}$ are then calculated based on n and Z. This means that a homogeneous fluid material that presents the same amplitude and phase of the reflection and transmission coefficients effectively replaces the metamaterial.

Figure 6:
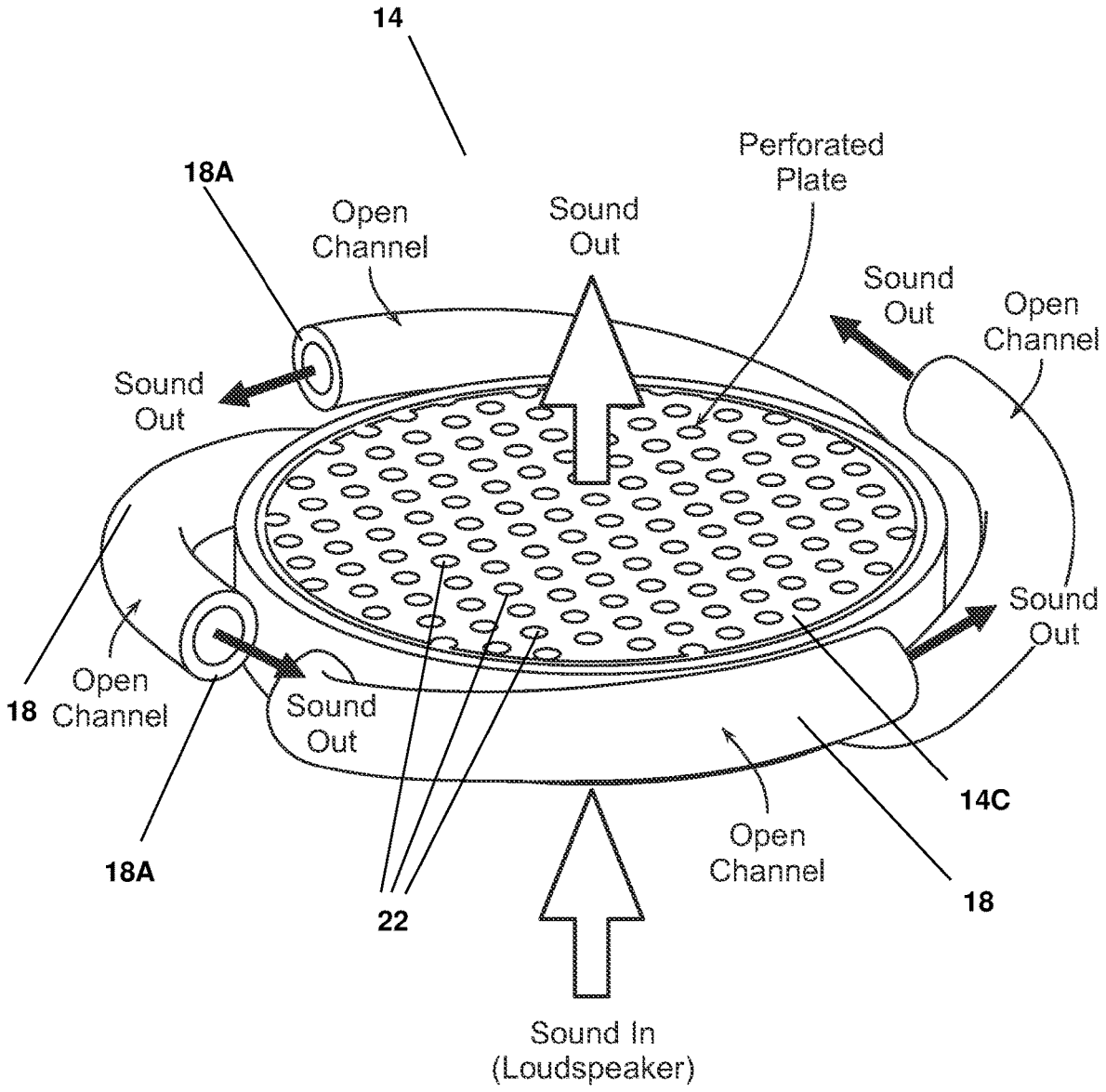
FIG. 6 shows a perspective 3-dimensional cross-sectional view of the acoustic metamaterial (AMM) passive impedance matching device according to one embodiment of the present disclosed technology.
Figure 7:
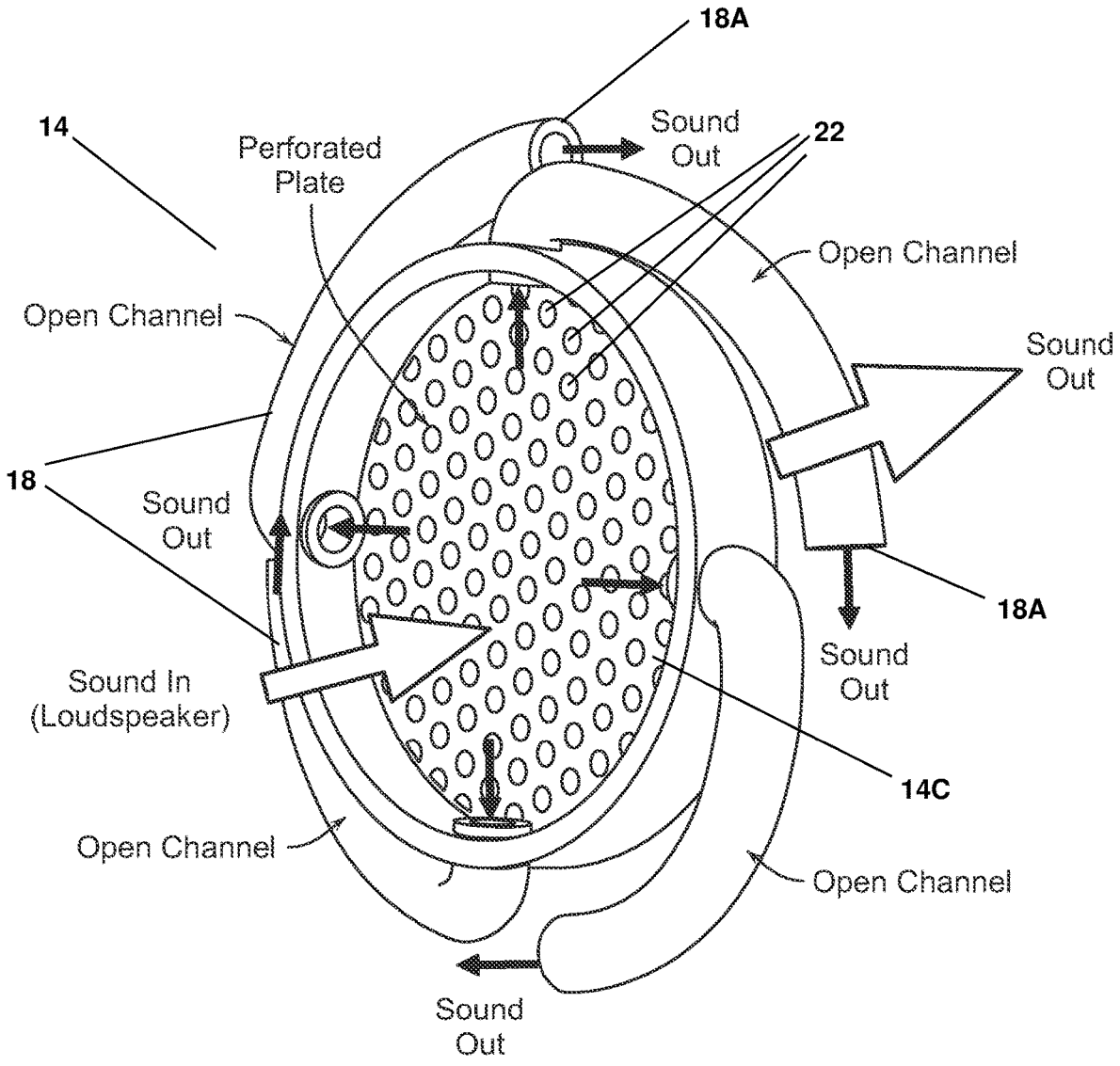
FIG. 7 shows another exploded view of the AMM passive impedance matching device for a loudspeaker, illustrating the resistive perforated plates and the inductive open tubes of the AMM passive impedance matching device as well as the configuration of the AMM passive impedance matching device with respect to sound waves coming from the loudspeaker according to one embodiment of the present disclosed technology.

FIGS. 6 and 7 show a perspective cross-sectional view of the acoustic metamaterial (AMM) passive impedance matching device according to one embodiment of the present disclosed technology. The AMM passive impedance matching device 10 is shown with perforated plates and side open channels 18. The number of perforated plates and the hole pattern of the perforations on the plate depends on the acoustic resistance required. Similarly, inductive reactance of the loudspeaker determines the dimensions and number of side channels 18 (e.g., open tubes).

In embodiments, the acoustic metamaterial passive impedance matching device 10 comprises a baffle 12 including an upper end 12A and a lower end 12B opposite the lower end 12A, a plurality of plates stacked concentrically with respect to one another, a plurality of slots 16 positioned between the plates 14, a side channel 18 extending outside of at least one of the plates 14, and a spoke 20 interconnecting the plates 14 to one another. Each of the plates 14 includes a central region 14C including a plurality of perforations 22. A slot of the plurality of slots 16 is positioned between two adjacently stacked plates 14. The side channels 18 and the perforations 22 in conjunction generate an acoustic impedance that balances the acoustic impedance of the loudspeaker 24 (see FIG. 8).

In some embodiments, the side channel 18 includes a plurality of side channels spaced periodically along the plates 14. In other embodiments, the plurality of side channels 18 and the plurality of plates 14 alternate in arrangement. The plurality of side channels 18 each include open ends 18A to provide an inductive reactance. Each of the plurality of plates 14 includes a different quantity of perforations 22 with respect to each of the other of the plurality of plates 14. For example, in some embodiments, the quantity of perforations 22 per plate 14 decreases from the upper end 12A toward the lower end 12B, such that the topmost plate includes more perforations 22 while the lowermost plate includes the least perforations 22.

In view of the foregoing, the number of side channels 18 and the number/quantity of perforations 22 on each individual plate 14 are functions of the impedance of the loudspeaker 24. Indeed, the quantity of the side channels 18 and the pattern and the quantity of the perforations 22 are dependent on the impedance of the loudspeaker 24. Further, the dimension of the side channels 18 is a function of the reactance of the loudspeaker 24. Indeed, the dimensions of the side channels 18 are dependent on the reactive impedance of the loudspeaker 24.

Figure 8:
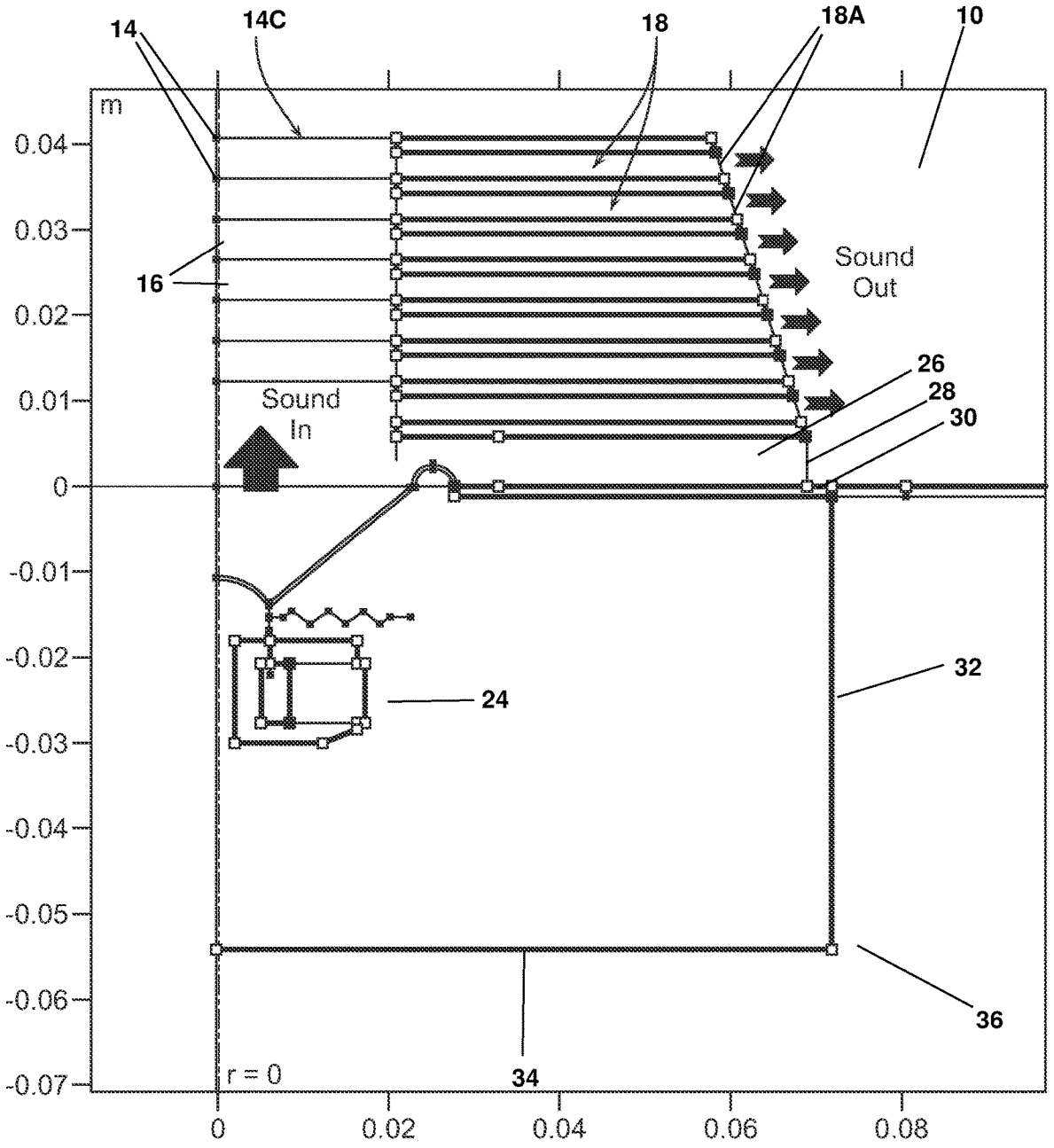
FIG. 8 shows a 2-dimensional view of the AMM passive impedance matching device mounted onto a loudspeaker assembly, illustrating the resistive perforated plates and the inductive open tubes of the AMM passive impedance matching device as well as the configuration of the AMM passive impedance matching device with respect to the loudspeaker according to one embodiment of the present disclosed technology.
Figure 9:
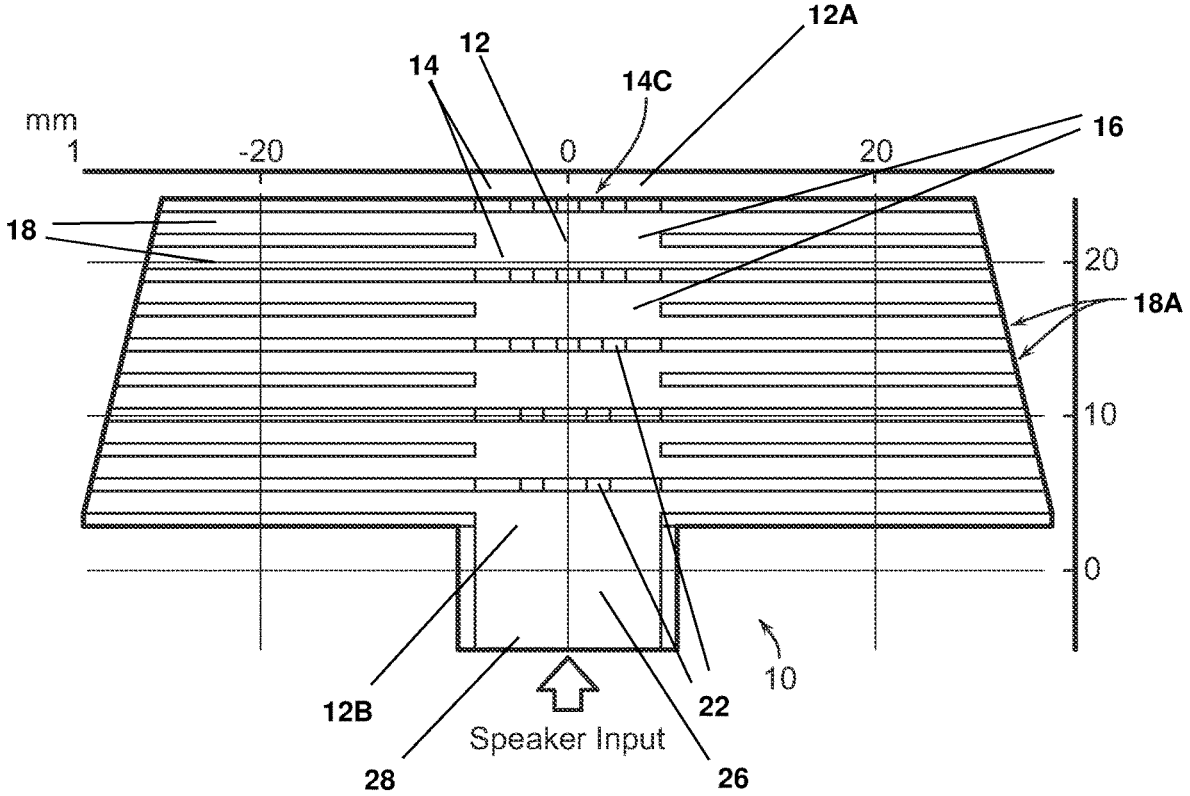
FIG. 9 shows a side elevation view of the AMM passive impedance matching device, specifically for a smartphone, illustrating the resistive perforated plates and the inductive open tubes of the AMM passive impedance matching device as well as the configuration of the AMM passive impedance matching device with respect to the incoming sound waves from the loudspeaker according to one embodiment of the present disclosed technology.

Referring to FIG. 7, FIG. 8, and FIG. 9, simultaneously, FIG. 7 shows an exploded view of the AMM passive impedance matching device without a loudspeaker assembly, illustrating the resistive perforated plates and the inductive open tubes of the AMM passive impedance matching device as well as the configuration of the AMM passive impedance matching device with respect to the loudspeaker according to one embodiment of the present disclosed technology. FIG. 8 shows a 2-dimensional axisymmetric view of the AMM passive impedance matching device mounted onto a loudspeaker assembly, illustrating the resistive perforated plates and the inductive open tubes of the AMM passive impedance matching device as well as the configuration of the AMM passive impedance matching device with respect to the loudspeaker according to one embodiment of the present disclosed technology. FIG. 9 shows a side elevation view of the AMM passive impedance matching device for a micro-speaker, usually used in devices like smartphone, laptops, tablets etcs., illustrating the resistive perforated plates and the inductive open tubes of the AMM passive impedance matching device as well as the configuration of the AMM passive impedance matching device with respect to the micro-speaker according to one embodiment of the present disclosed technology. Generally, FIGS. 7-9 show the implementation of the AMM passive impedance matching device 10 with resistive perforated plates and inductive side channels 18 (see FIG. 7). A loudspeaker 24 is housed in an enclosure 32 with a back cover 34 forming the loudspeaker unit 36. The AMM passive impedance matching device 10 is then placed or connected on top of the loudspeaker unit 36.

In embodiments, the lower end 12B of the baffle 12 includes a bracket for mounting the baffle 12 to the loudspeaker unit 36. In some embodiments, the bracket 26 includes a plurality of mounting apertures 28 protruding outwardly from baffle 12. Each of the mounting apertures 28 corresponds to mounting holes 30 on the loudspeaker unit 36. The mounting apertures 28 and mounting holes align to receive a fastener therethrough for securing the baffle 12 to the loudspeaker unit 36.

In embodiments, the plates 14 increase in diameter from the upper end 12A to the lower end 12B, such that the plate furthest from the loudspeaker 24 includes the smallest diameter and the plate 14 closest to the loudspeaker 24 includes the largest diameter. In other embodiments, the plates 14 are uniform in diameter from the upper end 12A to the lower 12B, such that the plates 14 include substantially equal diameters.

Figure 10:
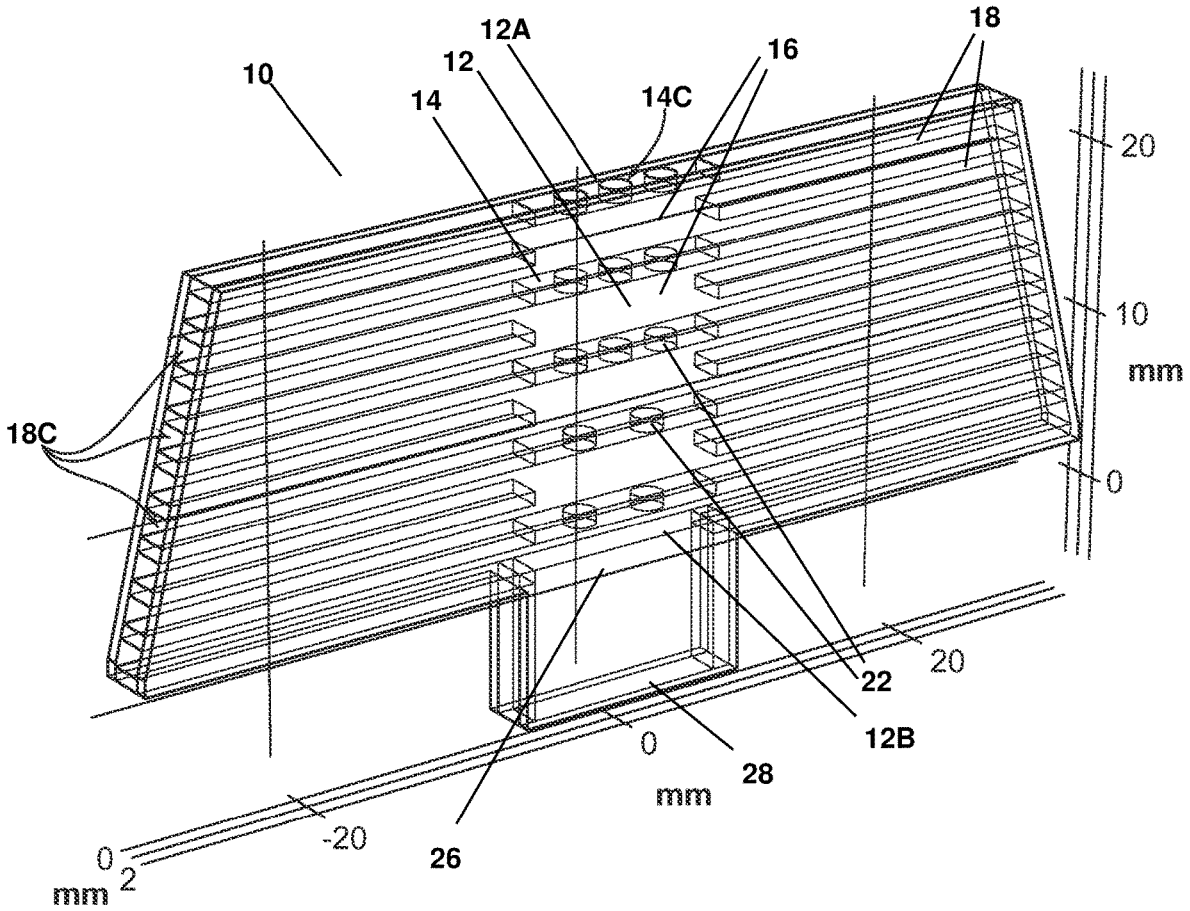
FIG. 10 shows a 3-dimensional perspective view of the AMM passive impedance matching device specifically for a smartphone, illustrating the inductive open tubes and the capacitive closed tubes of the AMM passive impedance according to another embodiment of the present disclosed technology.

FIG. 10 shows a top perspective view of the AMM passive impedance matching device, illustrating the inductive open tubes of the AMM passive impedance according to another embodiment of the present disclosed technology. The AMM passive impedance matching device 10 is based on resistive and inductive TL elements. The inductive elements are implemented using side channels 18, which are open at both ends.

Figure 11:
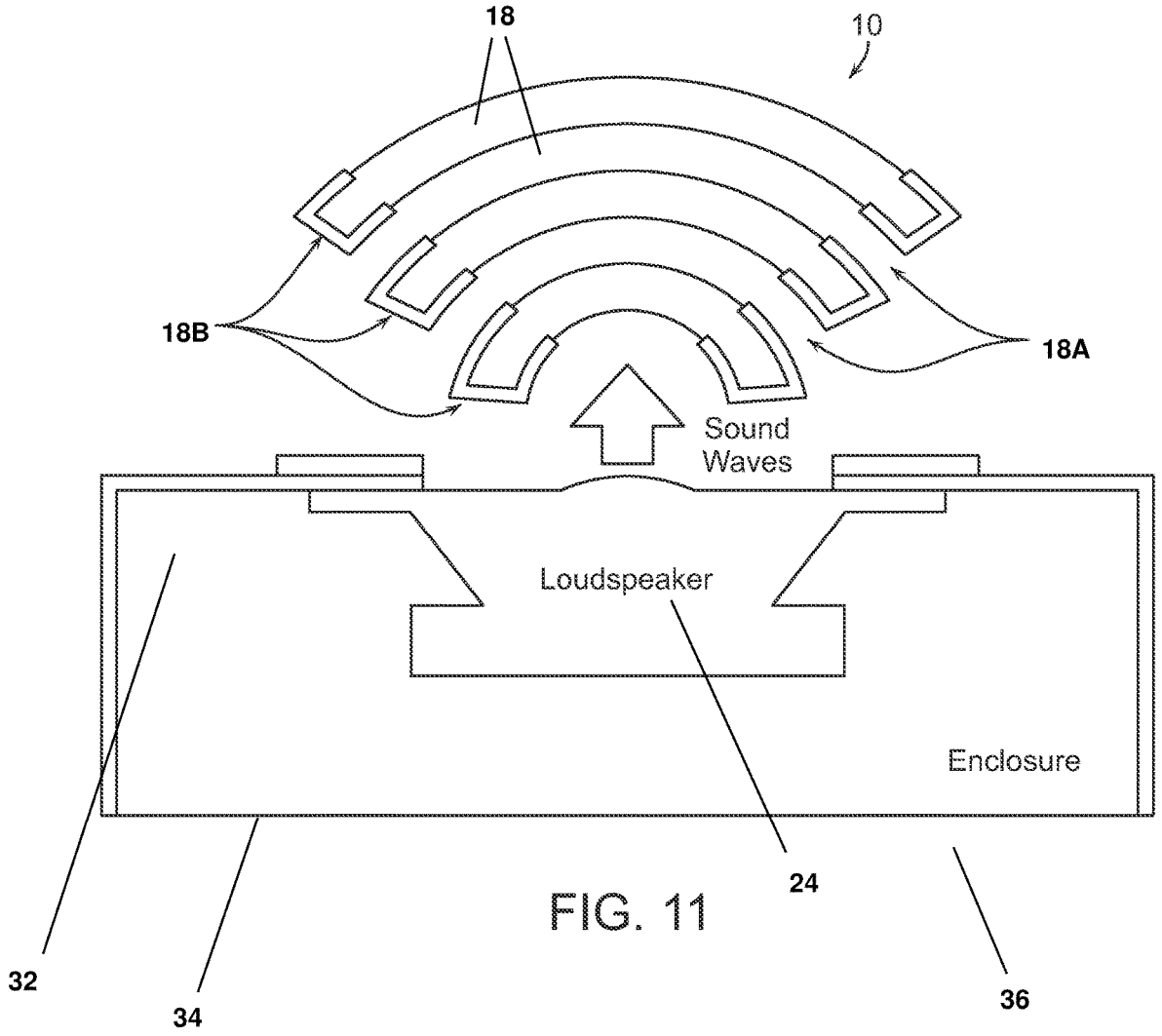
FIG. 11 shows a schematic view of the AMM passive impedance matching device with a loudspeaker assembly, illustrating the resistive perforated plates, the inductive open tubes, and the capacitive closed tubes of the AMM passive impedance matching device as well as the configuration of the AMM passive impedance matching device with respect to the loudspeaker according to another embodiment of the present disclosed technology.

FIG. 11 shows a schematic view of the AMM passive impedance matching device with a loudspeaker assembly, illustrating the resistive perforated plates, the inductive open tubes, and the capacitive closed tubes of the AMM passive impedance device as well as the configuration of the AMM passive impedance matching device with respect to the loudspeaker according to another embodiment of the present disclosed technology. The AMM passive impedance matching device 10 includes a combination of resistive and reactive impedance, where the reactive impedance consists of both inductive and capacitive elements, can also be used in the impedance matching device. The perforated plates 14 provide the resistive impedance.

In embodiments, the plurality of side channels 18 further comprises a second set of side channels 18B including closed ends to provide a capacitive reactance in addition to the inductive reactance provided by the first set of side channels 18A with open ends.

A scaled version based on impedance matching system presented herein can be used for smaller loudspeakers and micro-speakers used in various electronic devices, such as laptops, tablets, smart speakers, smartphones etc.

Any device or step to a method described in this disclosure can comprise or consist of that which it is a part of, or the parts which make up the device or step. The term "and/or" is inclusive of the items which it joins linguistically and each item by itself.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein above are also contemplated and within the scope of the invention.

What is claimed is:

1. An acoustic metamaterial passive impedance matching device for use in matching a complex acoustic impedance load of a loudspeaker, comprising:

a baffle including an upper end and a lower end adapted to attach to the loudspeaker, the upper end opposite the lower end, a plurality of plates stacked concentrically with respect to one another from the upper end to the lower end, each of the plates including a central region including a plurality of perforations, a plurality of slots positioned between the plates, a slot of the plurality of slots positioned between two adjacently stacked plates, a side channel extending annularly around a circumference of at least one of the plurality of plates, the side channel defining a chamber including a height that is greater than the height of the plates and an interior volume enclosing a predetermined volume of air, and a spoke interconnecting the plurality of plates to one another, the side channel and the perforations generating an acoustic resistance and reactive impedance that matches the complex acoustic impedance load of the loudspeaker.

2. The acoustic metamaterial passive impedance matching device of claim 1, wherein the side channel includes a plurality of side channels spaced periodically between the plates.

3. The acoustic metamaterial passive impedance matching device of claim 2, wherein the plurality of side channels and the plurality of plates alternate in arrangement.

4. The acoustic metamaterial passive impedance matching device of claim 3, wherein the plurality of side channels each include open ends to provide an inductive reactance.

5. The acoustic metamaterial passive impedance matching device of claim 4, wherein each of the plurality of plates includes a different quantity of perforations with respect to each of the other of the plurality of plates.

6. The acoustic metamaterial passive impedance matching device of claim 5, wherein the quantity of side channels and the quantity of perforations on each individual plate are functions of the resistance and reactance of the loudspeaker, the quantity of the side channels and the pattern and the quantity of the perforations are dependent on the resistance and reactance of the loudspeaker.

7. The acoustic metamaterial passive impedance matching device of claim 6, wherein the plates increase in diameter from the upper end to the lower end, such that the plate furthest from the loudspeaker includes the smallest diameter and the plate closest to the loudspeaker includes the largest diameter.

8. The acoustic metamaterial passive impedance matching device of claim 6, wherein the plates are uniform in diameter from the upper end to the lower, such that the plates include substantially equal diameters.

9. The acoustic metamaterial passive impedance matching device of claim 6, wherein the plurality of side channels further comprises a second set of side channels, each side channel including closed ends to provide a capacitive reactance.

10. The acoustic metamaterial passive impedance matching device of claim 6, wherein the lower end of the baffle includes a bracket for mounting the baffle to the loudspeaker.

11. The acoustic metamaterial passive impedance matching device of claim 10, wherein the bracket includes a plurality of mounting apertures protruding outwardly from baffle, each of the mounting apertures corresponding to mounting holes of the loudspeaker, the mounting apertures configured to receive a fastener therethrough for securing the mounting apertures to the mounting holes.

12. The acoustic metamaterial passive impedance matching device of claim 4, wherein the quantity of perforations per plate decreases from the upper end toward the lower end, such that a topmost plate includes more perforations while a lowermost plate includes the least perforations.

13. The acoustic metamaterial passive impedance matching device of claim 12, wherein the dimension of the side channels is a function of the reactance of the loudspeaker, the dimensions of the side channels dependent on the reactance of the loudspeaker.

* * * * *